United States Patent [19]

Field, Jr. et al.

[11] Patent Number: 4,908,997

[45] Date of Patent: Mar. 20, 1990

[54] METHOD AND SYSTEM FOR GENERATING WIDE-RANGE TORIC LENSES

[75] Inventors: Edgar L. Field, Jr.; Joe D. Stith; Phillip D. Hill, all of Muskogee, Okla.

[73] Assignee: Coburn Optical Industries, Inc., Muskogee, Okla.

[21] Appl. No.: 242,806

[22] Filed: Sep. 12, 1988

[51] Int. Cl.[4] ..... B24B 13/06; B24B 49/10

[52] U.S. Cl. ..... 51/284 R; 51/165.71; 51/165.74; 51/105 LG

[58] Field of Search ... 51/105 LG, 106 LG, 101 LG, 51/165.71, 165.74, 165.75, 283 E, 284 E, 284 R; 91/363

[56] References Cited

U.S. PATENT DOCUMENTS

| | | | |
|---|---|---|---|
| 3,492,764 | 2/1970 | Dalton | 51/284 |
| 3,958,492 | 5/1976 | Curless | 91/363 R |
| 4,493,168 | 1/1985 | Field, Jr. | 51/165.87 |

*Primary Examiner*—Frederick R. Schmidt
*Assistant Examiner*—Jack Lavinder
*Attorney, Agent, or Firm*—Bradford E. Kile

[57] ABSTRACT

A method and system for generating a lens by grinding a lens blank with a tool in a working position calls for a diamond tool to be disposed only angularly, the lens being moved in an X,Y relationship so that the relative cutting position is properly maintained. The angular disposition and X,Y relationship of the tool and the lens are pre-calculated by a computer, and the digital data thus obtained are converted to analog data for controlling a servo system. In accordance with the invention, when a certain range of curves is entered via a digital keyboard, a computation is made by computer to determine if an interference between the spindle holding the diamond tool and lens will exist, or if an interference between the lens and a chuck will exist. If an interference will exist, the chucked lens is caused to rotate around the optic axis by precisely 180°, the lens is generated halfway through, the chucked lens is then retracted a small amount to provide clearance, and the chucked lens is then returned to its original position so that the second half of the lens may be generated. Other features include a linear position detection circuit for detecting the linear position of the chucked lens and an initiation circuit for initiating rotation of the chucked lens.

21 Claims, 6 Drawing Sheets

METHOD AND SYSTEM FOR GENERATING WIDE-RANGE TORIC LENSES

DESCRIPTION

1. Technical Field

The present invention relates to a method and system for generating wide-range toric lenses, and more particularly to a method and system for generating wide-range toric lenses under computer control so as to preclude the necessity of changing the cutting tool when the radius of the curves cut decreases.

2. Background Art

The art of preparing ophthalmic lenses from glass blanks entails two major processes; first, the lens blanks are surface ground with a prescriptive front and back curvature to provide a desired optic quality or characteristic; then, the lenses are ground to a desired edge shape to fit a preselected frame, the peripheral edge surface of the lens typically being beveled or finished to cooperate with a reciprocal bevel on an interior peripheral surface of a frame.

Various arrangements for lens generation, including lens generation under computer control, have been previously disclosed in the following U.S. Pat. Nos.: Coburn—2,086,327; Suddarth—3,449,865; Suddarth et al—3,458,956; and Field, Jr.—4,493,168. Each of the latter patents is assigned to the assignee of the present invention.

Other lens generating arrangements of the prior art are directed to the generation of a convex (or positive) toric surface or to the generation of a concave (or negative) toric surface, and to the reduction or elimination of elliptical error problems introduced during lens generation. For example, see the following patents: 2,633,675; 3,117,396; 3,492,764; 3,624,969; 3,790,875; 4,264,249; 4,271,636; and 4,574,527.

Other electronic-controlled or computer-controlled lens processing operations are disclosed in the following patents: 3,762,821; 3,781,096; 4,414,871; 4,455,901; and 4,460,275.

Finally, the following patents are of background interest for their disclosures of various other lens fabrication or lens processing arrangements:

| | | | | |
|---|---|---|---|---|
| | 3,529,841; | | 3,763,597; | 3,786,600; |
| 3,794,314; | 3,832,920; | | 3,874,127; | 3,896,688; |
| 3,962,832; | 3,971,170; | | 3,994,101; | 4,068,413; |
| 4,084,458; | 4,164,097; | | 4,179,851; | 4,184,292; |
| 4,267,672; | 4,277,916; | | 4,341,045; | 4,349,207; |
| 4,382,351; | 4,419,849; | | 4,434,581; | 4,447,180; |
| 4,468,896; | 4,582,076; | and | 4,582,332. | |

None of the prior patents provides a solution to a particular problem encountered during wide range toric lens generation. Specifically, lens generators of the prior art typically require a cutting tool change when the radius of the curves cut decreases. This is mandated by the physical geometries that constrain the cutting tool from completing its cut over the entire surface of the lens. As explained in more detail below, the problem arises when an interference between the spindle holding the diamond tool and the lens itself, or an interference between the chuck holding the lens and the diamond cutting tool, is encountered. Such an interference precludes complete generation of the curves.

Accordingly, there is a need to provide a wide-range toric lens generator, preferably computer-controlled, for the generation of wide-range toric lenses without encountering the "interference" problems just discussed. The computer-controlled wide-range toric lens generating method and system discussed below meet this need.

DISCLOSURE OF INVENTION

The present invention relates to a method and system for generating wide-range toric lenses, and more particularly a method and system for generating wide-range toric lenses under computer control and in such a manner as to preclude the "interference" problems discussed above as encountered by systems and methods of the prior art.

More specifically, the present invention departs from the lens generation concepts disclosed in the prior art, and in particular in the prior patents listed above, by virtue of the relationship between the diamond tool and the lens. In accordance with the present invention, the diamond tool is disposed only angularly and the lens is moved in an X,Y relationship so that the relative cutting position is properly maintained. The angular disposition and X,Y relationship are pre-calculated by a computer associated with the inventive system.

The present invention is designed so that, when a certain range of curves is entered via a digital keyboard, a computation is made by the computer to determine if an interference will exist. If an interference will exist, then the chucked lens is caused to rotate around the optic axis precisely 180°, and the lens is generated halfway through. Then, the chucked lens is retracted by a small amount for clearance with respect to the tool, the chucked lens is returned to its original state by rotation around the optic axis by 180°, and the second half of the lens is generated. By precisely controlling the position of the lens, the junction of the two cuts is not perceivable. In addition, all of the limitations and disadvantages previously discussed with respect to prior art arrangements and methods, which limitations and disadvantages normally occur in cutting the second half of the lens, are eliminated by the presently disclosed method and system.

Therefore, it is a primary object of the present invention to provide a method and system for generating wide-range toric lenses.

It is an additional object of the present invention to provide a method and system for generating wide-range toric lenses in which interference problems between the spindle holding the tool and the lens, or between the chuck holding the lens and the tool, are eliminated.

It is an additional object of the present invention to provide a method and system for generating wide-range toric lenses under computer control.

With the above and other objects in mind, as will hereinafter will appear, the invention will be more fully described and understood by reference to the detailed description below and the accompanying drawings.

BEST MODE FOR CARRYING OUT THE INVENTION

The invention will now be described in more detail with reference to the various figures of the drawings.

Figure 1A:
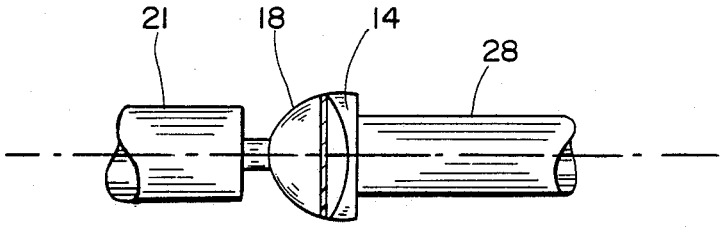
FIGS. 1A–1C illustrate the interference problem between the spindle holding a diamond cutting tool and the lens, which problem is encountered when generating a minus or concave curve.
Figure 1B:
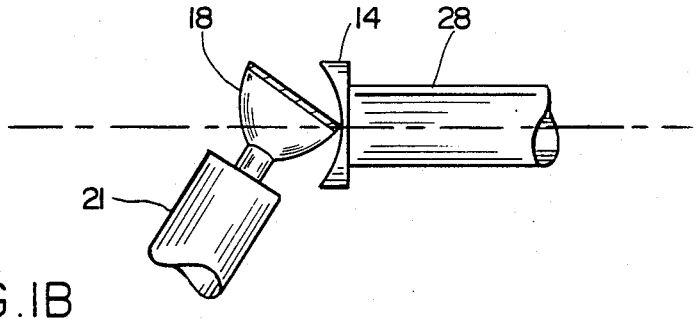
Figure 1C:
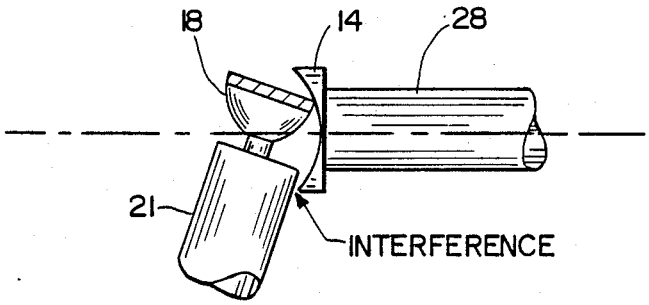
Figure 2A:
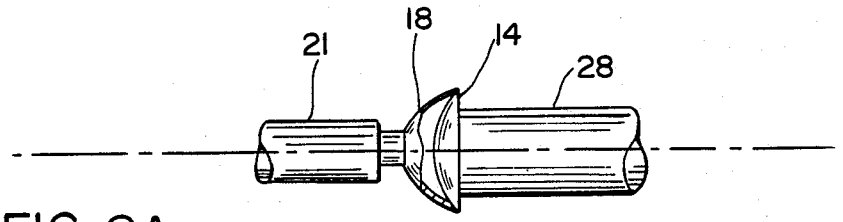
FIGS. 2A–2C illustrate the interference problem between the chuck holding the lens and the diamond cutting tool, which problem is encountered when generating a plus or convex curve.
Figure 2B:
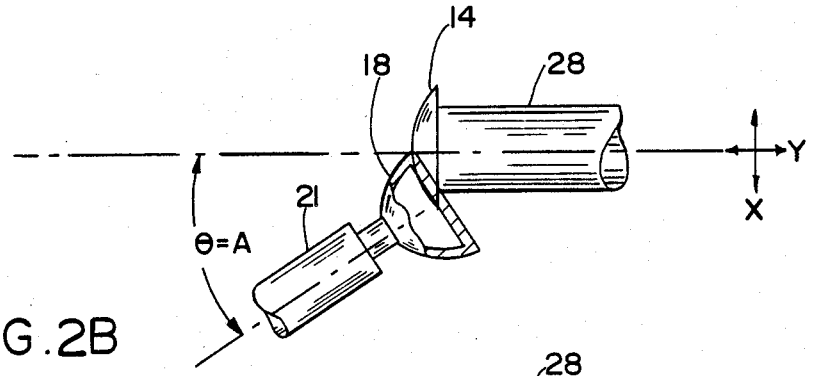
Figure 2C:
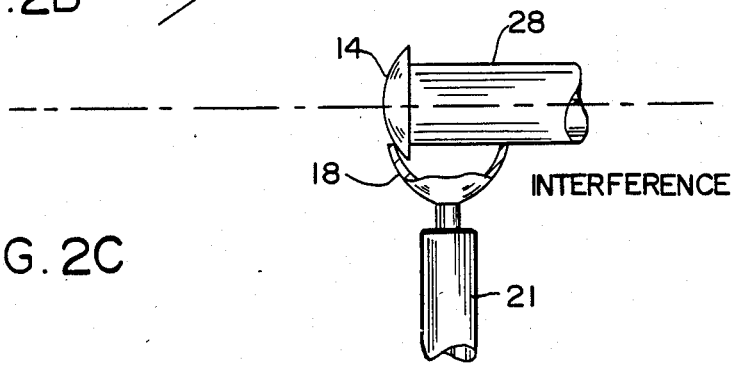

FIGS. 1A–1C illustrate the "interference" problem encountered during generation of minus or concave curves, while FIGS. 2A–2C illustrate the "interference" problem encountered when generating plus or convex curves.

FIG. 1A depicts a lens 14 mounted on a chuck 28, and a tool 18 mounted on its spindle 21, the tool 18 being in a starting position with respect to the lens 14 which is to be ground by the tool 18. FIG. 1B shows the tool 18 at the halfway point in its cutting operation with respect to the lens 14, while FIG. 1C shows the tool 18 in a position almost through the cutting operation. At that point, an interference between the spindle 21 and the lens 14 is apparent. Such a problem is magnified when larger lens blanks are being ground. Moreover, since a hood (known as a "splash hood", and seen in FIG. 3) typically encircles the grinding components to contain coolant, the hood itself can present mechanical constraints on the cutting path of the tool associated with it.

FIG. 2A shows a tool 18 in its starting position with respect to a plus or convex lens 14 mounted on chuck 28. FIG. 2B shows the tool 18 halfway through its cutting operation, while FIG. 2C shows the tool 18 in a position almost through its cutting operation. At that point, an interference exists between the tool 18 and the chuck 28 holding the lens 14, and thus complete generation of the curves is not permitted.

Figure 3:
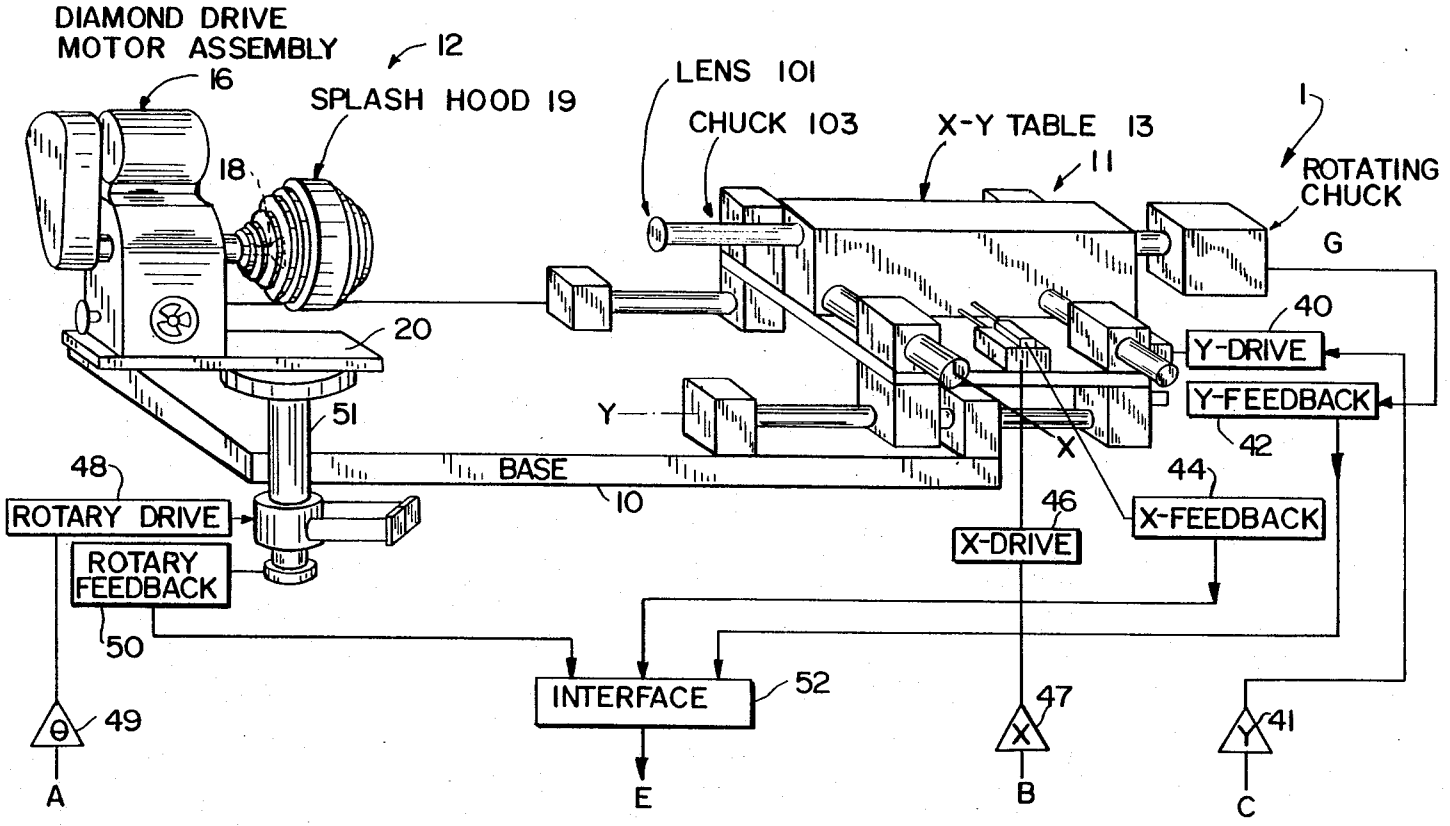
FIG. 3 is a diagrammatic representation of the computer-controlled lens generating arrangement in accordance with the present invention.

FIG. 3 is a diagrammatic representation of the computer-controlled lens generating arrangement of the present invention. In basic terms, the lens generating arrangement 1 comprises a lens holding assembly 11 and a grinding tool assembly 12.

Further referring to FIG. 3, the lens holding assembly 11 comprises an X-Y table 13 to which the lens chuck 103, which holds the lens 101 to be fabricated, is connected. X-Y table 13 is connected to X-drive stage 46 and Y-drive stage 40, from which it receives X-drive and Y-drive command signals for moving the chuck 103 and lens 101 carried thereby, in accordance with X-Y coordinates, toward the grinding tool assembly 12. X-drive stage 46 and Y-drive stage 40 receive input signals B and C, respectively, via respective amplifiers 47 and 41 from a computer 200 (FIG. 5) associated with the computer-controlled lens generating arrangement 1. Conversely, the X-Y table 13 provides an X-feedback signal to the computer 200 via X-feedback stage 44 and interface 52 (output E thereof), while the rotating chuck system 100 of FIG. 3 provides a Y-feedback signal G, via Y-feedback state 42 and interface 52, to the computer 200 of FIG. 5.

Figure 5:
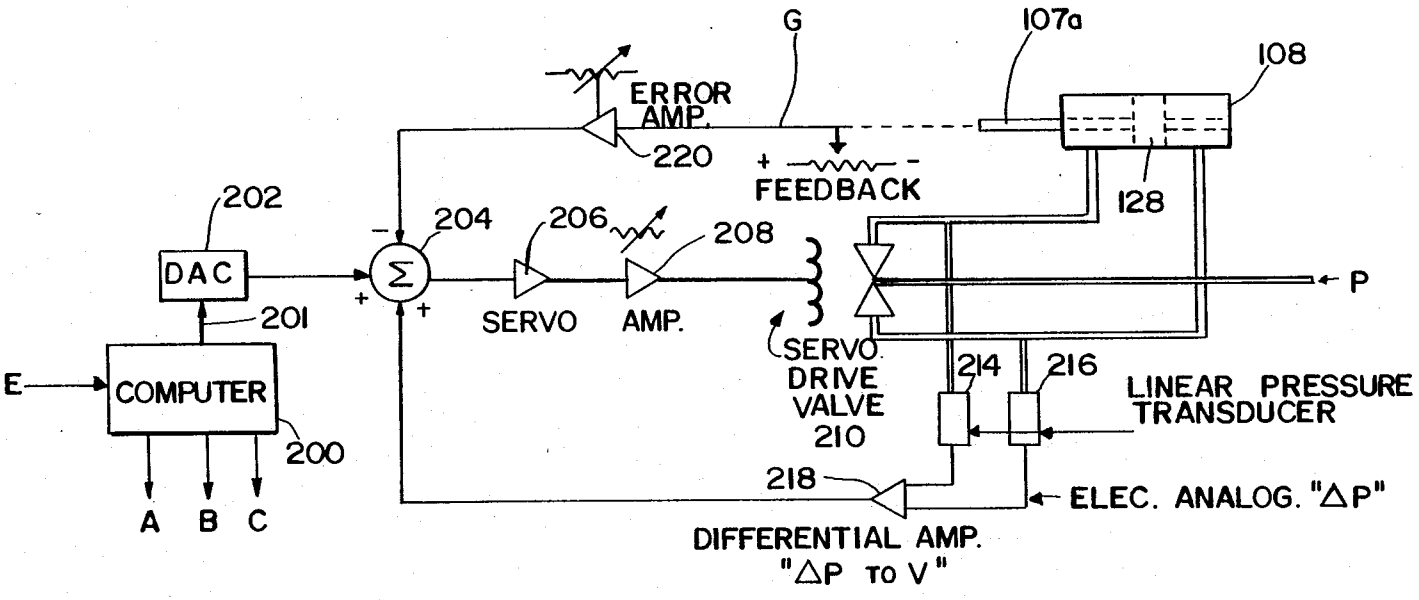
FIG. 5 is a schematic diagram of a control and feedback circuit for controlling linear movement of the chuck and lens in accordance with the present invention.

The grinding tool assembly 12 basically comprises a grinding tool or diamond tool 18 disposed within splash hood 19, both of these elements being connected to a diamond drive motor assembly 16, the latter being mounted on a grinding assembly base 20. Angular or arc-like rotation of the grinding tool 18 with respect to the lens 101 carried by chuck 103 during fabrication is accomplished by means of rotary drive stage 48 in response to reception of computer-generated rotary control input A, received via amplifier 49 from computer 200 (FIG. 5). In response thereto, rotary drive stage 48 actuates rotary shaft 51 to accomplish the desired angular or arc-like rotation of the tool 18. A rotary feedback signal is detected by rotary feedback stage 50 which is connected to the rotary shaft 51, and the rotary feedback signal generated by rotary feedback stage 50 is provided, via interface 52 (output E thereof), to the computer 200.

As described thus far, except for the provision of the rotating chuck system 100, the composition and operation of the lens-generating arrangement 1 of FIG. 3 is conventional in nature. Further details of the conventional aspects of operation of the lens-generating arrangement 1 of FIG. 3 are disclosed in Field, Jr.—4,493,168, which is assigned to the assignee of the present invention.

As mentioned previously, many existing lens generators require a cutting tool change when the radius of the curves cut decreases during wide-range toric lens generation. This is mandated by the physical geometries that constrain the cutting tool from completing its cut over the entire surface of the lens, as described previously with reference to FIGS. 1A–1C for a minus or concave curve, and with respect to FIGS. 2A–2C for a plus or convex curve.

The present invention departs from the generator concepts of the past by virtue of the relationship between the tool 18 and the lens 101 (FIG. 3). In accordance with the present invention, the tool 18 is disposed only angularly and the lens 101 is moved in an X,Y relationship so that the relative cutting position is properly maintained. The angular disposition and X,Y relationship are, as described in more detail below, pre-calculated by a computer 200 (FIG. 5), and the computer 200 generates digital data which are converted to analog data which, in turn, control a servo-drive system, also described in more detail below with reference to FIG. 5.

In accordance with the present invention, when a certain range of curves is to be generated during fabrication of the lens 101, the range of curves is entered via a digital keyboard (not shown) associated with the computer 200 (FIG. 5). The computer 200 performs a computation to determine if an interference will exist. If an interference will exist, then the lens 101 mounted on the chuck 103 is caused to rotate by means of a rotating chuck system 100. In this manner, the lens 101 rotates around its optic axis by precisely 180°, and the lens is generated halfway through by means of the tool 18. The lens 101 is then retracted from its working position by a small amount by withdrawal of the chuck 103 so as to provide necessary clearance between the lens 101 and the tool 18, whereupon the lens 101 is returned to its original position by means of rotation through another 180° by rotating chuck system 100. At this point, the second half of the lens 101 is generated by tool 18. By precise control of the position of lens 101, the junction of the two cuts is not perceivable, and all of the disadvantages or deficiencies mentioned above with respect to prior art systems and methods, which disadvantages and deficiencies normally occur in cutting the second half of the lens 101, are eliminated.

By use of the method and system of the present invention, the range of curves that may be cut without changing the diamond tool 18 is extended to the maximum. By way of comparison, whereas conventional generators—using a 3.25 inch pitch diameter and 3.5 inch outside diameter diamond tool—may cut up to about 10 diopters in a concave mode of operation, the present invention provides a means for extending the range to 11.8 diopters, which is a significant enhancement. As a result, the lack of necessity of stopping the operation of the grinding tool assembly 12 in order to change the tool 18 on a more frequent basis results in signficant increase in productivity in the lens-generating arrangement 1.

The angular disposition of the diamond cutting tool 18 relative to the tangent curve at the point of contact with lens 101 is determined by the following formulas:

$\sin\theta = D/2(R+r)$ for convex curves, and $\sin\theta = D/2(R-r)$ for concave curves, where D is the pitch diameter of the diamond tool 18, R is the desired radius to be cut, and r is the radius of the diamond tool cutting edge.

It should be further noted that, with respect to conventional lens generators, commonly called "radius arm generators", the diamond tool angle is set to determine the cross or cylinder meridian, and the arc of the diamond tool determines a base or spherical meridian. The spherical radius can be quite long for low power curves, and this generally limits the lower range of the generator. For example, a typical low range would be approximately 2 diopters. For a low-index material, such as one of index 1.498, this would correspond to a radius of 249 mm. Typically, most generators in the United States are calibrated in terms of a tool index, which is the hypothetical index of 1.530, and this would correspond to a radius of 265 mm. The radius is determined from the equation:

$R=(N-1)1000/\text{DIOPTERS}$ where R is in millimeters.

The 265 mm. value mentioned above represents a long radius and large supporting mass. By angularly disposing the diamond tool 18 and relatively positioning the lens 101 along an X,Y path, the relative disposition of the tool 18 and lens 101 can be such as to cut a lens with an infinite radius, i.e., a plano lens. In the case of a plano cut, the diamond tool 18 is held in a fixed position with the tool face parallel to the lens surface. Cutting is accomplished by simply moving the lens along the X path, which results in a plano surface.

Figure 4:
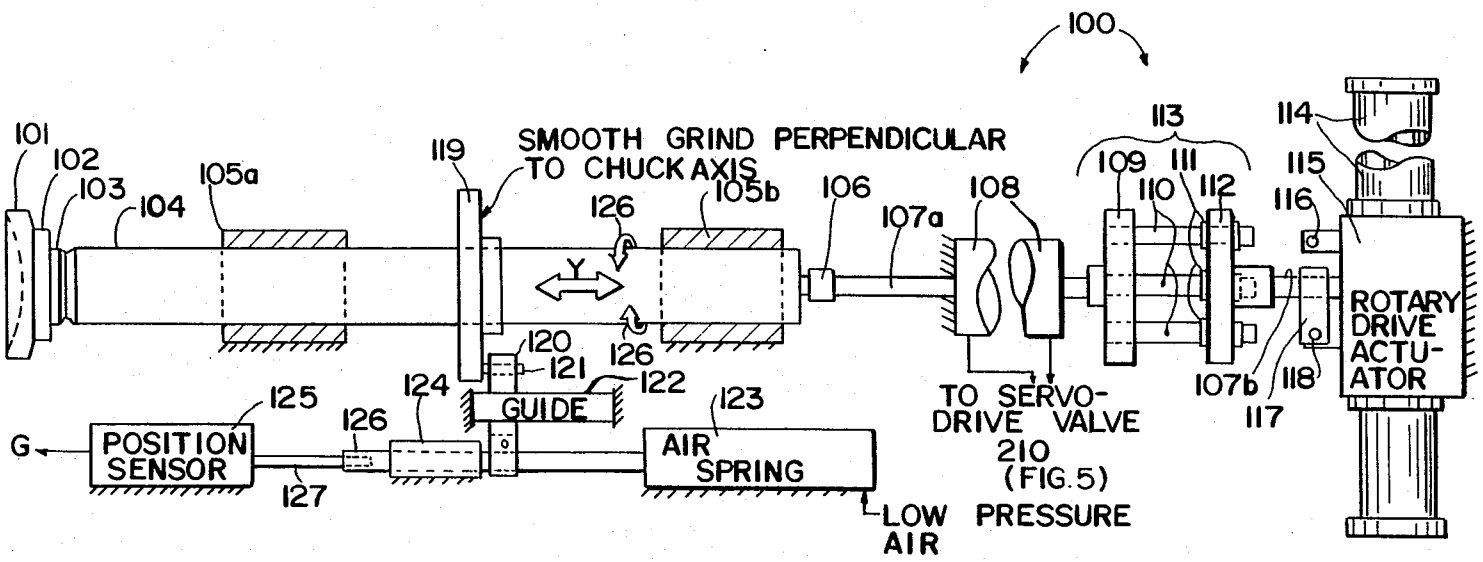
FIG. 4 is a more detailed diagrammatic representation of the rotating chuck system of the computer-controlled lens generating arrangement of the present invention.

FIG. 4 is a detailed diagram of the rotating chuck system 100 of the lens-generating arrangement 1 of FIG. 3. As seen in FIG. 4, the rotating chuck system 100 comprises the following elements: a block 102 on which a blocked lens 101 is mounted, chuck 103, chuck ram 104, rotary/linear bearings 105*a* and 105*b*, coupling 106, cylinder rod 107*a*, rotary actuator shaft 107*b*, hydraulic cylinder 108, rotatable sliding shaft 113 (comprising forward shaft holder 109, sliding shafts 110, linear bearings 111 and rear shaft guide 112), rotary drive cylinder 114, rotary drive actuator 115, zero-degree stop 116, stop arm 117, 180-degree stop 118, linear position transfer plate 119, plate follower 120, plate roller bearing 121, stabilizing guide 122, compression air spring 123, slider bearing 124, position sensor 125, slider rod 126 and potentiometer arm 127.

In FIG. 4, various elements are indicated as being fixed to a stationary frame by means of a plurality of diagonal lines arrayed on one side of the element. Thus, rotary-linear bearings 105*a* and 105*b*, hydraulic cylinder 108, rotary drive actuator 115, compression air spring 123, slider bearing 124, and position sensor 125 are indicated to be fixed to a stationary frame of the lens-generating arrangement.

Linear movement of the lens 101, block 102, chuck 103 and chuck ram 104 (and associated elements) is carried out in a direction indicated as the Y-axis (see the arrow designated "Y" in FIG. 4) by means of elongated hydraulic cylinder 108. The cylinder 108 is fixed to the stationary frame of the arrangement, and contains a piston 128 (see FIG. 5) which slides along the Y axis when the servo-drive valve 210 applies a pressure differential to the left and right interior sections of cylinder 108. Rotary motion of the lens 101, block 102 and chuck 103 is carried out by rotation by the chuck ram 104, as indicated by the arrows 126*a* in FIG. 4. Such rotational motion of the chuck ram 104 is brought about by actuation of rotary drive actuator 115.

Whereas any conventional mechanism for rotating the chuck ram 104 can be employed, preferably, a rotary drive actuator 15 driven by a hydraulic cylinder 114 is provided. In this preferred embodiment, rotary drive actuator 115 comprises a conventional rack and pinion system operated by means of hydraulic cylinder 114 in a manner which is evidence to those of skill in the art. In accordance with the present invention, rotary drive actuator 115 is capable of rotating the rotary actuator shaft 107*b* between two "dead stop" positions separated by 180°. For this purpose, rotary drive actuator 115 is provided with an adjustable zero-degree stop 116 and an adjustable 180-degree stop 118, and a stop arm 117 is mounted on rotary actuator shaft 107*b* so that, as shaft 107*b* rotates in one direction, it necessarily comes to a dead stop as a result of contact with zero-degree stop 116, and, as rotary actuator shaft 107*b* rotates in the opposite direction, it comes into contact with 180-degree stop 118. In this manner, in accordance with the present invention, lens 101 can be rotated by 180° in one direction for grinding of a first half of the lens 101, and can then be rotated back to its original position for grinding of the second half of lens 101.

The collection of elements indicated by reference numeral 113 comprises a rotatable sliding shaft which fixed position driver assembly. More specifically, rotatable sliding shaft 113 comprises forward shaft holder 109, rear shaft guide 112, sliding shafts 110 and linear bearings 111. By means of this mechanism linear motion along the Y-axis of drive shaft 107*a* is permitted without distributing the rotational position established by the rotary drive actuator 115. That is to say, during linear movement of drive shaft section 107*a*, as brought about by operation of hydraulic cylinder 108, sliding shafts 110 slide linearly within linear bearings 111 so that the distance between forward shaft holder 109 and rear shaft guide 112 varies in accordance with the distance moved by the chuck ram 104 and blocked lens 101, all of this being accomplished without disturbing the rotational position of blocked lens 101, as established previously by rotary drive actuator 115.

Conversely, the rotatable sliding shaft 113 permits rotation of the blocked lens 101 without disturbing the linear position thereof along the Y-axis, such linear position having been established by hydraulic cylinder 108, as operated by the servodrive valve 210 (FIG. 5). Specifically, rotary drive actuator 115 (FIG. 4) rotates drive shaft section 107*b*, and this rotational movement is transferred across rotatable sliding shaft 113 and through hydraulic cylinder 108 (via the internal piston 128 of FIG. 5) to drive shaft section 107*a* (FIG. 4), the latter causing rotational motion of chuck ram 104, thus accomplishing rotation of blocked lens 101. All of this is accomplished without disturbing the linear position of lens 101 along the Y-axis, as previously established by cylinder 108 and the servo-drive valve 210 (FIG. 5).

Since the linear movement just discussed is computer-controlled, some provision must be made for notifying the computer 200 (FIG. 5) of the linear position of the lens 101 at any point in time. With respect to sensing of the linear position of lens 101 along the Y-axis, position sensor (or potentiometer) 125 and potentiometer arm 127 are provided. A slider 126 is movable along arm 127, the slider 126 being coupled to chuck ram 104 via rotatable plate 119, plate follower 120, and plate roller-bearing 121. In operation, as chuck ram 104 moves along the Y-axis, rotatable plate 119 also moves along the Y-axis. Plate follower 120—as restrained by plate roller-bearing 121 and stabilizing guide 122—is held in close contact with plate 119 by the urging of air spring 123 operating in the compression mode. As plate 119 moves along the Y-axis, follower 120 also moves, and slider rod 126 moves correspondingly within sliding bearing 124. Movement of slider rod 126 along potentiometers arm 127 causes a variation in the electrical signal G generated by position sensor 125. This electrical signal G (seen also in FIG. 3) is provided, via Y-feedback 42 and interface 52, to the computer 200 of FIG. 5 as part of input signal E to the computer 200.

With respect to rotational movement of lens 101, due to the provision of "dead stop" elements in the form of zero-degree stop 116 and 180-degree stop 118, it is not necessary for the computer 200 to be aware of the precise rotational position of lens 101. When the computer 200 determines that rotation of the lens 101 is required, a solenoid-operated valve (not shown in FIG. 4) is acuated so as to provide positive or negative pressure (depending on the desired direction of rotation) to rotary drive cylinder 114 and, as previously discussed, the rack and pinion system of rotary drive actuator 115 operates to rotate shaft 107*b* accordingly. Once the stop arm 117 contacts one of the stops (116 or 118), a Hall-effect device (not shown in FIG. 4) is used to detect the "home" position, and the computer 200 (FIG. 5) is notified that rotation through 180° has been accomplished, whereupon actuation of the rotary drive cylinder 114 and rotary drive actuator 115 ceases; pressure is held on the system, which means that actuation does not cease, only the movement ceases.

It should be noted that, whereas the above-described preferred embodiment employs hydraulic means for accomplishing rotational and linear movement of lens 101, any conventional means, such as electric drives or electric control circuitry, can be employed without departing from the scope of the invention.

FIG. 5 is a block diagram of control and feedback circuitry employed by the computer 200 in controlling and detecting linear movement of the chuck ram 104 and blocked lens 101 of FIG. 4. As shown in FIG. 5, when linear movement of the chuck ram 104 and blocked lens 101 is desired, the computer 200 generates a digital actuation signal 201, such digital actuation signal being converted into an analog actuation signal by digital-to-analog converter (DAC) 202.

The analog actuation signal from DAC 202 is processed, together with an amplifier output signal from differential amplifier 218 and an error signal from error amplifier 220, in a summer 204, and the summation output signal is provided, via servo amplifiers 206 and 108, to servo-drive valve 210.

The servo-drive valve 210 is connected to a source of hydraulic pressure (not shown), and responds to the amplified summation output signal by providing respective pressures of corresponding values to respective ends of the hydraulic cylinder 108. A piston 128 is contained within the cylinder 108 and is located between the respective ends thereof so that, when one end of cylinder 108 is experiencing a greater pressure than the other end of cylinder 108, the piston 128 will move in the direction of that end experiencing less pressure. As a result, cylinder shaft section 107*a* and chuck ram 104 (FIG. 4) connected thereto will be moved in a direction dictated by the summation output signal of summer 204 (FIG. 5).

Referring to FIG. 4, as previously explained, as chuck ram 104 moves in a given direction, a corresponding electrical signal G is generated by position sensor 125, and this electrical signal G is provided, via error amplifier 220 (FIG. 5), to the negative input of summer 204. As the chuck ram 104 (FIG. 4) approaches the end of its desired movement, as commanded by the computer 200, the output of error amplifier 220 (FIG. 5) approaches a value approximately equal to the output of DAC 202, and accordingly the output of summer 204 approaches zero. As the output of summer 204 approaches zero, servo-drive valve 210 is moved to a "center valve" position at which pressures provided to the respective ends of cylinder 108 are equalized, and movement of piston 128, shaft section 107*a* and chuck ram 104 (FIG. 4) ceases.

Further referring to the circuitry of FIG. 5, the hydraulic output lines connecting the servo-drive valve 210 with respective ends of the cylinder 108 are preferably connected to respective linear pressure transducers 214 and 216 (although it should be noted that pressure transducers 214 and 216 can be eliminated, whereupon the system will perform with somewhat less, but still acceptable, precision). Transducers 214 and 216 generate electrical signals proportionate to the hydraulic pressures being applied by valve 210 to the respective ends of cylinder 108. These electrical signals generated by transducers 214 and 216 are provided as inputs to a differential amplifier 218, which performs a "difference" function with respect to these two inputs. Amplifier 218 produces an output signal representing the difference between the outputs of transducers 214 and 216, respectively, and amplifier 218 provides this output signal to a positive input of summer 204.

The latter arrangement functions as an initiating circuit serving to overcome natural inertia in the system during initial commanding of chuck ram movement by the computer 200. Specifically, when the computer 200 initially commands movement via DAC 202, summer 204 and servo amplifiers 206 and 208, servo-drive valve 210 moves a small distance so as to apply pressures of slightly different magnitude to the respective ends of cylinder 108. This small pressure differential between the ends of cylinder 108 is detected by transducers 214 and 216 in combination with differential amplifier 218, the amplifier 218 generating an amplified output signal which, when applied to the positive input of summer 204, serves to reinforce the electrical signal provided by DAC 202 to the other positive input of summer 204. Thus, as indicated above, initial inertia in movement of chuck ram 104 is overcome.

Figure 6:
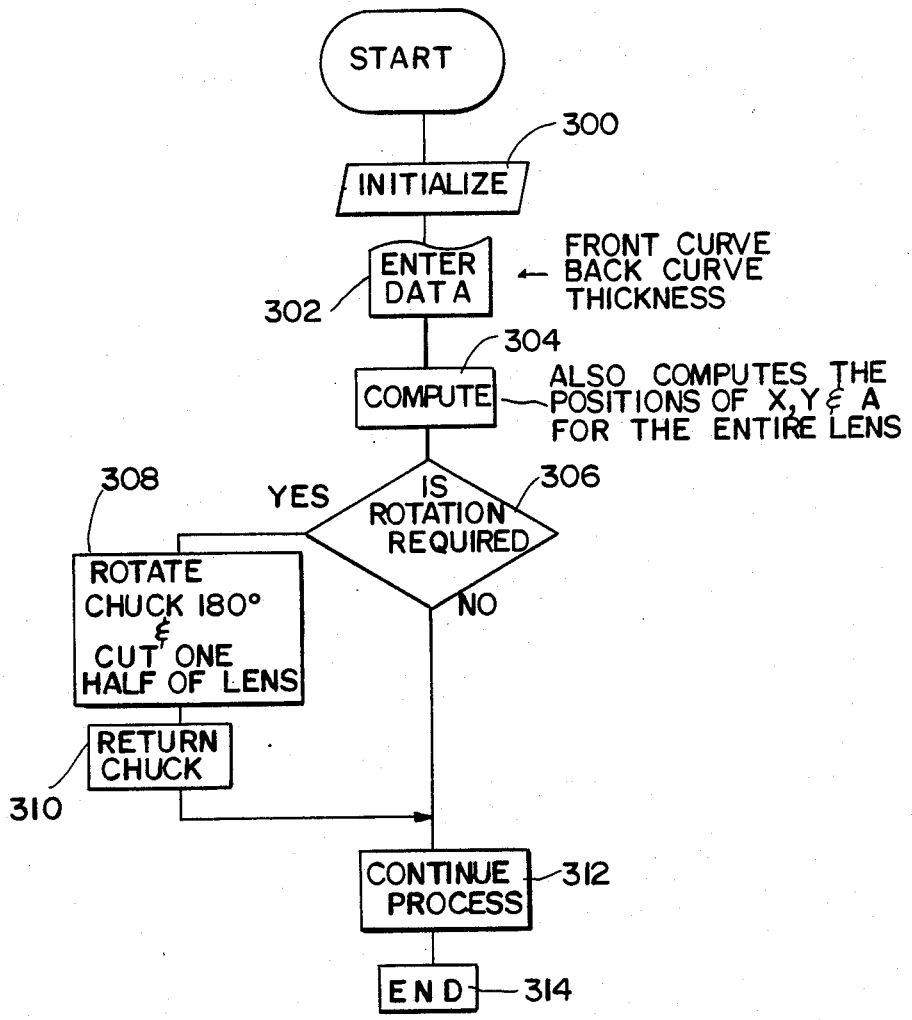
FIG. 6 is a flowchart of the computer operations performed by the computer associated with the lens generating arrangement of the present invention.

FIG. 6 is a flowchart of the operations of the computer 200 of FIG. 5 in accordance with the present invention. As mentioned previously, operation of the invention commences with the entry, via a digital keyboard (not shown), of a certain range of curves, based on which the computer 200 (FIG. 5) performs computations to determine if an interference will exist during lens generation.

Referring to FIG. 6, after initialization of the computer (block 300), the aforementioned data are entered, such data defining the front curve, back curve and lens thickness (block 302).

The computer 200 (FIG. 5) then performs the various computations referred to earlier, as well as other computations well known to those of skill in the art, so as to compute the X and Y positions (linear positions), as well as the A position (the angular position), for generation of the lens (see block 304 of FIG. 6). In this manner, the computer 200 (FIG. 5) determines whether or not an interference exists, and correspondingly whether or not rotation of the lens through 180° is required.

Once a determination is made to the effect that rotation is required (block 306 of FIG. 6), rotation of the lens 101 (FIG. 4) is commanded. As previously discussed, the rotation of lens 101 is accomplished by operation of rotary drive actuator 115. Once the lens is rotated through 180°, it is moved into a working position relative to the tool by linear movement of chuck ram 104 along the Y-axis, and one-half of the lens is cut (see block 308 of FIG. 6).

Once the latter operation is completed, the lens 101 is again withdrawn along the Y-axis, reverse-rotated through 180°, and then moved again into proximity with the tool so that the other half of the lens can be cut (see blocks 310 and 311 of FIG. 6). Once the latter operation is completed, this two-step grinding of the lens is completed and processing continues (blocks 312 and 314).

If rotation is not required (block 306), the entire lens is cut (block 307), and the process then continues (blocks 312 and 314).

While preferred forms and arrangements have been shown in illustrating the invention, it is to be understood that various changes in detail and modifications may be made without departing from the spirit and scope of this disclosure.

We claim:

1. A method for generating a lens by grinding a lens blank with a tool in a working position, said method comprising the steps of:

(a) providing a rotatable chuck moveable into said working position in proximity to said tool;

(b) mounting the lens blank on the rotatable chuck;

(c) determining whether or not an interference between the tool and at least one of the lens blank and the chuck will occur during grinding of the lens blank;

(d) if step (c) indicates that the interference will occur, grinding a first half of the lens blank in a first operation, rotating the lens blank by 180°, and then grinding a second half of the lens blank in a second operation separate from the first operation.

2. The method of claim 1, wherein generating of the lens takes place under control of a computer, and wherein step (c) comprises providing the computer with data defining characteristics of the lens generation, and processing the data to determine whether or not the interference will occur during grinding of the lens blank.

3. The method of claim 2, wherein said data provided to the computer includes front curve data, back curve data and lens thickness data.

4. The method of claim 1, wherein step (d) comprises grinding the first half of the lens blank in a first operation, withdrawing the lens blank from the working position, rotating the lens blank by 180°, returning the lens blank to the working position, and grinding the second half of the lens blank in a second operation.

5. The method of claim 1, wherein step (d) comprises rotating the lens blank by 180°, returning the lens blank to the working position, grinding the first half of the lens blank in a first operation, withdrawing the lens blank from the working position, reverse-rotating the lens blank by 180°, returning the lens blank to the working position, and grinding the second half of the lens blank in a second operation.

6. A system for generating a lens by grinding a lens blank with a tool in a working position, said system comprising:

chuck means for holding said lens blank, said chuck means being movable along a linear axis toward and away from the working position, said chuck means being rotatable about the linear axis;

linear moving means for moving said chuck means and said lens blank along the linear axis toward and away from the working position;

rotary means for rotating said chuck means and said lens blank about the linear axis;

computer means for receiving and processing data characterizing the lens to be generated;

said computer means further comprises means for determining whether or not interference between the tool and at least one of the lens blank and the chuck means will occur during grinding of the lens blank; and means responsive to said means for determining interference for grinding a first half of said lens blank, actuating said rotary means to rotate said lens blank 180°, and grinding a second half of said lens blank.

7. The system of claim 6, wherein said data received and processed by said computer means includes front curve data, back curve data and lens thickness data.

8. The system of claim 6, wherein, between said grinding of said first half of said lens blank in said first operation and said rotation of said chuck means and said lens blank by 180°, said linear moving means moves said chuck means and said lens blank away from the working position, and wherein, between the rotation of said chuck means and said lens blank by 180° and the grinding of said second half of said lens blank in said second operation, said linear moving means moves said chuck means and said lens blank toward the working position.

9. The system of claim 6, wherein, prior to the grinding of said first half of said lens blank in said first operation, said rotary means rotates said chuck means and said lens blank by 180° about the linear axis, and said linear moving means moves said chuck means and said lens blank toward the working position; and wherein, between the grinding of said first half of said lens blank in said first operation and the rotation of said chuck means and said lens blank by 180°, said linear moving means moves said chuck means and said lens blank away from the working position; and wherein, between the rotation of said chuck means and said lens blank by 180° and the grinding of said second half of said lens blank in said second operation, the linear moving means moves said chuck means and said lens blank toward the working position.

10. The system of claim 6, wherein said linear moving means comprises a servo-drive valve and a hydraulic cylinder connected thereto, said servo-drive valve being responsive to commands from said computer means for providing hydraulic pressure to said hydraulic cylinder, said hydraulic cylinder being responsive to said hydraulic pressure for moving said chuck means along the linear axis.

11. The system of claim 10, wherein said hydraulic cylinder comprises an elongated cylindrical shell and a piston generally centrally located within said cylindrical shell, said piston being connected to said chuck means.

12. The system of claim 6, wherein said rotary means comprises a rotary drive actuator responsive to commands from said computer means for rotating said chuck means in either one of two directions, first stop means for stopping the rotation of said chuck means in a first one of said two directions, and second stop means for stopping the rotation of said chuck means in a second one of said two directions.

13. The system of claim 6, further comprising linear position detecting means connected to said chuck means for detecting movement of said chuck means toward and away from said working position, and for generating an electrical signal corresponding to the position of said chuck means and said lens blank relative to said working position.

14. The system of claim 13, wherein said linear position detecting means comprises a plate mounted on said chuck means, a plate follower contacting said plate and moving in unison with said plate as said chuck means moves toward and away from said working position, a movable rod connected to said plate follower and moving in unison with said plate follower as said chuck means moves toward and away from said working position, and a potentiometer in electrical contact with said movable rod for generating an electrical signal corresponding to the position of said chuck means and said lens blank relative to said working position.

15. The system of claim 14, further comprising spring means in contact with said movable rod for exerting a constant force on said movable rod, whereby said plate follower connected to said movable rod remains in constant contact with said plate as said chuck means moves.

16. The system of claim 6, wherein said computer means generates a digital actuation signal, said system further comprising converting means for converting said digital actuation signal to an analog actuation signal, and wherein said linear moving means comprises a servo-drive valve and a hydraulic cylinder connected thereto, said servo-drive valve being responsive to said analog actuation signal for providing hydraulic pressure to said hydraulic cylinder, said hydraulic cylinder being responsive to said hydraulic pressure for moving said chuck means.

17. The system of claim 16, further comprising linear position detecting means for detecting a linear position of said chuck means and generating an analog position signal which varies in accordance with changes in linear position of said chuck means, and summer means connected to said converting means, said linear position detecting means, and said servo-drive valve for receiving and processing said analog actuation signal from said converting means and said analog position signal from said linear position detecting means so as to determine when commanded movement of said chuck means has taken place.

18. The system of claim 17, wherein said hydraulic cylinder comprises an elongated cylinder having a first end and a second end, and wherein said servo-drive valve is hydraulically connected to said first end and said second end, respectively, of said hydraulic cylinder, said servo-drive valve imposing respective pressures on said first end and said second end, respectively, of said hydraulic cylinder, and wherein said servo-drive valve responds to a nonzero signal from said summer means by creating an off-balance condition between the hydraulic pressures imposed on said first end and said second end, respectively, of said hydraulic cylinder, whereby to actuate said hydraulic cylinder to move said chuck means in accordance therewith.

19. The system of claim 18, wherein said servo-drive valve responds to a zero signal from said summer means for balancing the respective pressures of said first end and said second end of said hydraulic cylinder, whereby to stop movement of said chuck means.

20. The system of claim 17, further comprising initiating means connected between said servo-drive valve and said summer means, and responsive to a relatively small pressure difference imposed by said servo-drive valve on a first end and a second end of said hydraulic cylinder for generating an initiating electrical signal, said summer means receiving and processing said initiating electrical signal, whereby to provide an initial impetus to movement of said chuck means.

21. The system of claim 20, wherein said servo-drive valve generates respective pressures at said first end and said second end, respectively, of said hydraulic cylinder, said initiating means comprising a first transducer hydraulically connected to said first end of said hydraulic cylinder for translating the respective pressure at said first end into a first electrical signal, said initiating means further comprising a second transducer hydraulically connected to said second end of said hydraulic cylinder for translating the respective pressure at said second end into a second electrical signal, and a differential amplifier connected to said first and second transducers for receiving and processing said first and second electric signals so as to develop an amplifier output signal corresponding to the difference between said first and second electric signals, said amplifier output signal comprising said initiating electrical signal received and processed by said summer means.

* * * * *